US005377765A

United States Patent [19]

Kaylor

[11] Patent Number: 5,377,765

[45] Date of Patent: Jan. 3, 1995

[54] METHOD AND MEANS FOR EXTINGUISHING TANK FIRES

[75] Inventor: Joseph B. Kaylor, Manassas, Va.

[73] Assignee: Valkyrie Scientific Proprietary, L.C., Manassas Park, Va.

[21] Appl. No.: 21,014

[22] Filed: Feb. 22, 1993

[51] Int. Cl.[6] ..... A62C 3/06

[52] U.S. Cl. ..... 169/44; 169/15; 169/46; 169/66

[58] Field of Search ..... 169/66, 44, 46, 15

[56] References Cited

U.S. PATENT DOCUMENTS

| | | | |
|---|---|---|---|
| 1,115,887 | 11/1914 | Bartels | 169/44 |
| 2,414,260 | 1/1947 | Hunter | 169/15 X |
| 3,475,333 | 10/1969 | Meldrum et al. | 169/169 X |
| 4,662,454 | 5/1987 | Uchiyama et al. | 169/15 |
| 4,664,199 | 5/1987 | Grant et al. | 169/66 X |

FOREIGN PATENT DOCUMENTS

| | | | |
|---|---|---|---|
| 3620574 | 12/1987 | Germany | 169/15 |
| 1095338 | 12/1967 | United Kingdom | 169/66 |
| 1299599 | 3/1987 | U.S.S.R. | 169/66 |

*Primary Examiner*—David M. Mitchell
*Assistant Examiner*—Gary C. Hoge
*Attorney, Agent, or Firm*—Roland H. Shubert

[57] ABSTRACT

Fires in tanks storing combustible liquids are extinguished by injecting a mixture of water, a foam-forming concentrate and an inert gas into the tank at a point below the surface of the stored liquid forming an upwelling foam column which explodes upon the liquid surface and spreads across that surface to extinguish the fire and prevent its reignition.

11 Claims, 3 Drawing Sheets

METHOD AND MEANS FOR EXTINGUISHING TANK FIRES

TECHNICAL FIELD

This invention relates to systems and techniques for extinguishing fires of flammable liquids stored in tanks.

More particularly, this invention relates to the extinguishment of fires aboard tankers and in large, above ground storage tanks for crude oil, refined products and other flammable liquids by providing methods and means for the creation and placement of a fire extinguishing foam on the surface of the burning liquid.

BACKGROUND ART

The state of the art is well summarized in a report prepared by Henry Persson and entitled "Design, Equipment and Choice of Tactics are Critical When Fighting Large Tank and Bund Fires." That report is further identified as Brandforsk Project: 612-902; Swedish National Testing and Research Institute, Fire Engineering, SP Report 1992:02. The purpose of that report was to develop knowhow based on the experience and recommendations of fire experts to provide a practical basis for the design and planning of foam extinguishing systems for large tank and bund fires. A bund fire is one within the embankment or dike surrounding a storage tank.

A traditional approach to the fighting of such fires has been to direct streams of water and foam onto the fire site through monitors or even hand-held nozzles. In order to successfully extinguish large fires using traditional techniques it is necessary to have available an adequate supply of water and foam concentrate to allow the application of foam liquid at a minimum rate of 6.5 $l/m^2/min$ to the burning surface for some 60 to 90 minutes. The report indicates agreement among the experts that concentrating foam application on as small an area in the tank as possible is far superior to the previously accepted technique of fighting tank fires with several small monitors distributed around the circumference of the tank. Concentrating the foam application at one point more quickly establishes a bridge head, or initial foam cover, thus increasing the effectiveness of subsequently applied foam.

Among other findings of the report are that no successful fire extinguishing operation has been verified in tanks over about 45 m in diameter. Indeed, some experts hold that a tank of 45 m in diameter represents about the largest that can be extinguished with mobile equipment. It appears to be the general consensus of the experts that tanks up to at least 60 m in diameter can be extinguished if the tanks are equipped with fixed "over-top" systems to apply foam. It is considered possible as well to extinguish fires in even larger tanks if the over-top system is supplemented with a bottom feed system.

A fixed, over-top system comprises permanently installed piping and foam sprinkler nozzles within the tank itself at a level above the liquid surface when the tank is filled to capacity. A bottom feed system employs a hose array with foam deploying nozzles adapted to float on the surface of the stored liquid and to rise and fall with the liquid as the tank is filled and emptied. Both systems require connection to a water source and to a supply of foam concentrate. That connection may be permanent one through a direct attachment to the water mains and to a store of foam but the systems are more commonly supplied from a mobile unit which is connected to a system through hoses at the time of need. Both systems are difficult to maintain and are essentially impossible to test without contamination of the tank contents.

Fires aboard tankers carrying either crude oil or refined petroleum products pose many of the same problems as do fires in stationary tanks. Consequently, tanker fires have been traditionally fought using much the same tactics used in the fighting of stationary tank fires. However, the difficulties of access and of the coordination of equipment, personnel and decision-making are ordinarily vastly greater in a tanker fire than those encountered at land locations.

Fires in tankers and stationary storage tanks, while relatively uncommon, pose enormous risks. Those risks include the threat of injury or death to people aboard the ship or in the area or engaged in fighting the fire, the likelihood of huge property losses, and the nearly certain contamination of soils, beaches, ground and surface water and air. Further, the intense thermal radiation always threatens to ignite adjacent structures and tanks thus compounding the risks and increasing the potential losses.

With this background, it can readily be appreciated that fire fighting tactics and systems which can more quickly and surely bring under control and extinguish fires aboard tankers and in tanks, particularly those fires in large stationary or mobile tanks, is of great environmental and economic importance.

DISCLOSURE OF THE INVENTION

This invention provides devices and techniques for establishing a foam cover on the surface of a burning liquid contained in a tank to thereby control and extinguish the fire and prevent its re-ignition and burn-back. Fluid flow is established into the tank at a location below the surface of the flammable liquid contained therein and preferably at a location adjacent the bottom of the tank. Water is then pumped into the tank, a foam concentrate is added to the flowing water and an inert gas, preferably comprising carbon dioxide, is merged with the mixture of foam concentrate and water prior to entry of the combined stream into the tank. Gas filled foam bubbles rising through the flammable liquid carry the foam components rapidly to the surface of the burning liquid where the inert gas escapes and tends to snuff the flame while the foam forms a rapidly spreading layer atop the liquid surface to extinguish the fire and prevent its burn-back.

Hence, it is an object of this invention is to provide improved methods for fighting and extinguishing fires in petroleum tankers and storage facilities.

Another object of this invention is to provide improved means and apparatus for establishing an extinguishing foam layer on the surface of a burning liquid contained in a storage tank.

Yet another object of this invention to provide improved methods and techniques for extinguishing fires of flammable liquids contained in storage tanks.

Other objects will be apparent from the following description of exemplary embodiments and techniques.

DESCRIPTION OF THE DRAWING

Specific embodiments of the invention are illustrated in the drawing in which.

MODES FOR CARRYING OUT THE INVENTION

Figure 1:
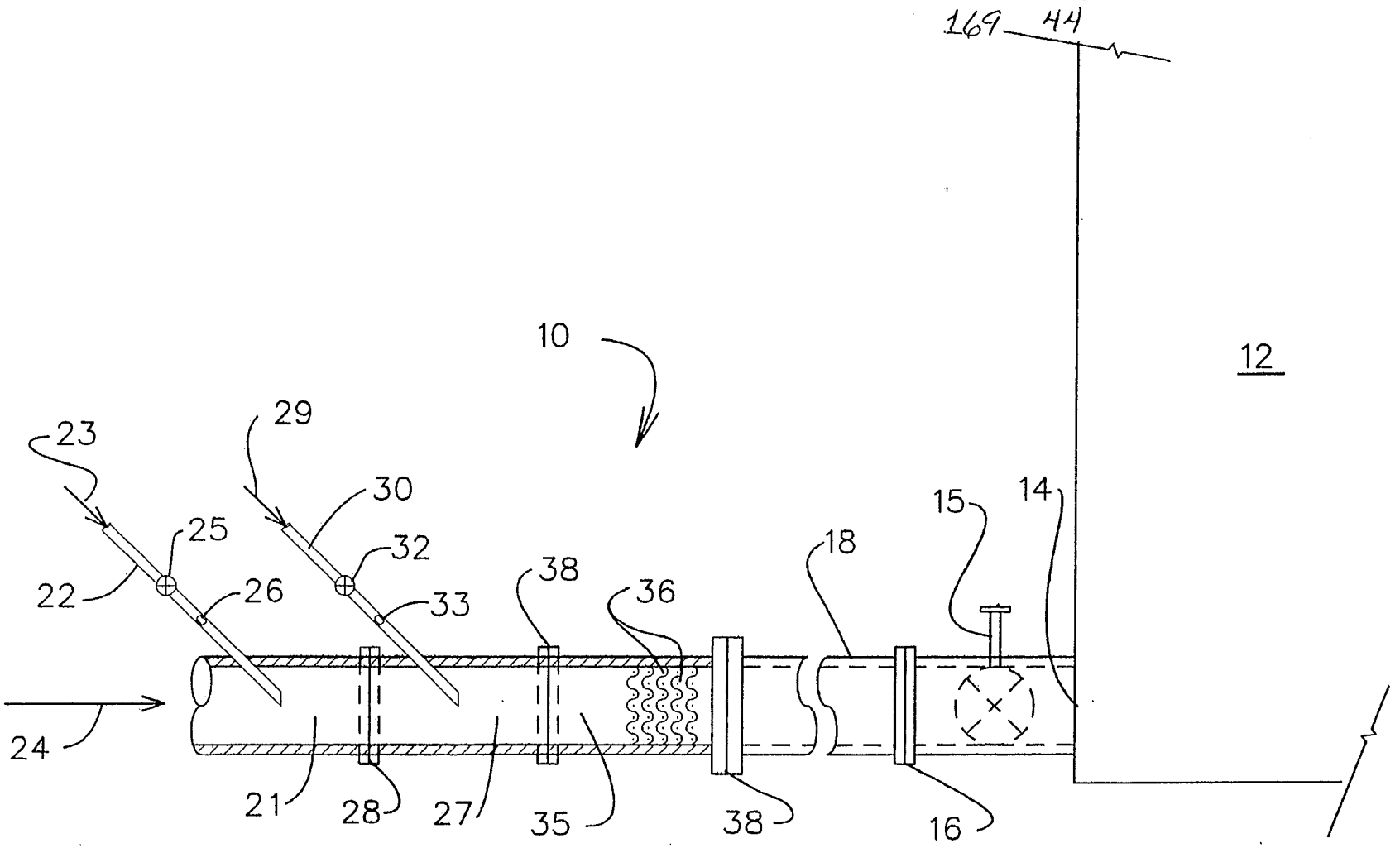
FIG. 1 is a partial sectional view of apparatus for the injection of foam-forming constituents into a liquid-filled tank.
Figure 2:
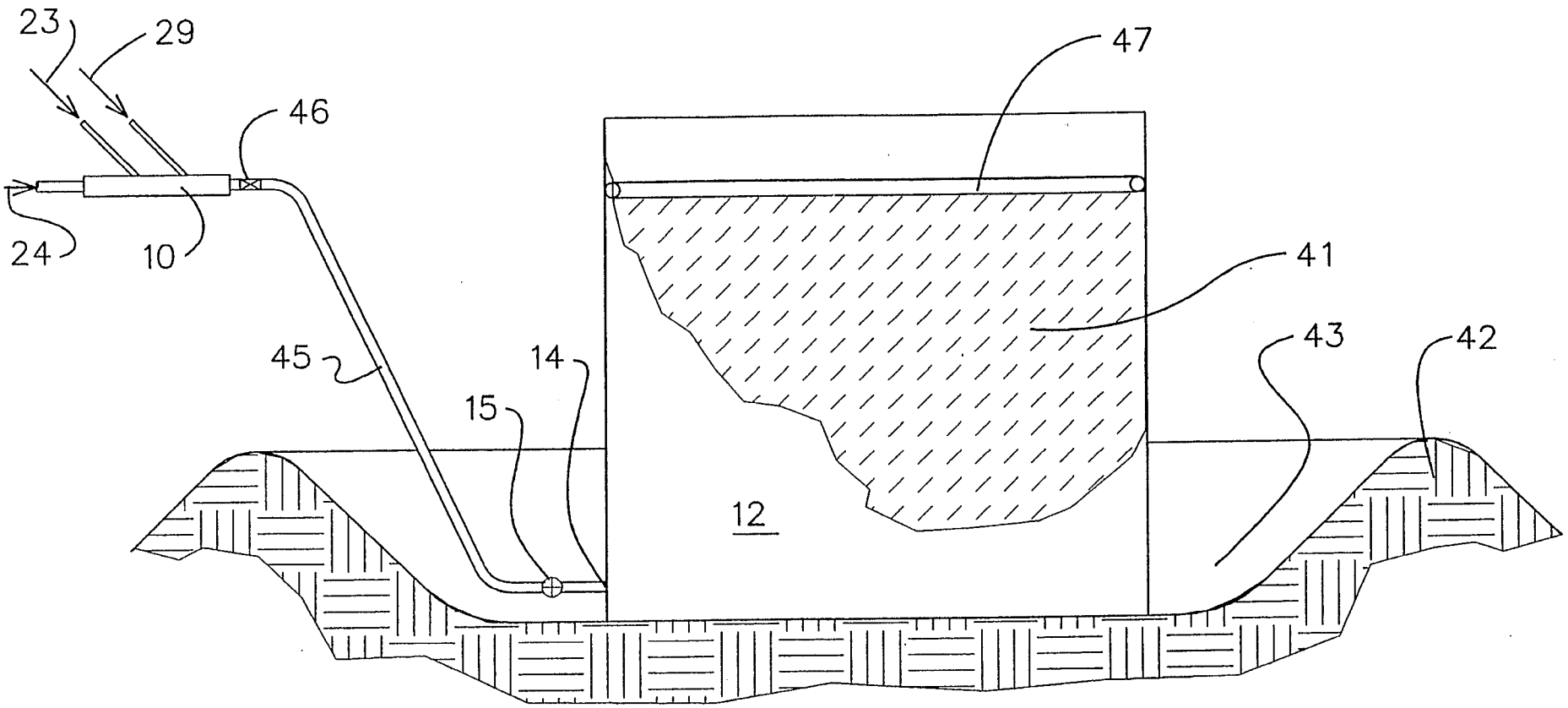
FIG. 2 is a partial sectional view of the apparatus of this invention as it would be used in the fighting of a fire in a diked tank.

Various embodiments of this invention will be described and discussed in detail with references to the drawing figures. Turning first to FIG. 1, there is shown a device 10 adapted to mix foam components and to inject them into a liquid-filled tank 12. Tank 12 may be a large, fixed, above-ground tank such as those conventionally used for the storage of crude oil and refined petroleum products or it may comprise a mobile tank such as, for example, a compartment of a tanker vessel. In the event that tank 12 is an above-ground storage tank, it ordinarily would be spaced apart from adjacent tanks or other structures and usually would be surrounded by a dike 42 (FIG. 2). Dike 42 forms a basin 43 sized so as to contain the contents of tank 12 in the event of spills or tank rupture.

Tank 12, whether it be fixed or mobile, ordinarily will be equipped with one or more ports 14 extending through the tank wall to provide means for fluid communication between the interior and exterior of the tank. In a fixed tank, port 14 generally terminates at a flange 16 which is adapted for connection to a hose, pipe or other conduit means and includes a valve 15 to control the flow of fluid into and out of the tank. In a mobile tank, such as a compartment within a tanker, port 14 may connect to the system of pumps and piping for the loading and discharge of cargo or for the transfer of liquid from one tank compartment to another.

In either event, injection means 10 connects to port 14 by way of hose or other conduit means 18 through connector fitting 20. Means 10 itself includes three distinct zones serially arranged within a conduit. The first zone 21 comprises means 22 for the metered addition of a foam concentrate from source 23 to a flowing stream of water from supply 24. Foam addition means 22 is provided with valve assembly 25 which serves to both start and stop the flow of foam concentrate into the stream of water flowing through means 10 and to prevent backflow from zone 21. The flow rate of foam concentrate through means 22 may be controlled by means of orifice 26 or through use of an upstream metering pump (not shown) so as to obtain a desired ratio of foam concentrate to water in zone 21. That desired ratio will ordinarily be set so as to obtain a final foam concentration ranging from about 0.5% to 10% but preferably within the range of about 1% to 6%

Second zone 27 is located downstream of the first zone and functions to introduce a metered stream of gas or gas forming liquid from source 29 into the flowing stream of water and foam concentrate exiting from the first zone. Gas entry is by way of gas introduction means 30 having associated therewith valve means 32 which function to start and stop flow and to prevent backflow from zone 27. The rate at which gas or gas forming liquid is introduced into zone 27 may be controlled by way of flow limiting orifice 33. Generally speaking, the rate of gas introduction will be sufficient to provide a gas volume, measured at ambient temperature and pressure, which is at least about equal the volume of liquid flowing through the zone and preferably two or more times that volume.

The fluids leaving second zone 27 comprise two phases, one liquid and the other gas, which can tend to separate and to travel along the conduit in slugs. Just downstream of zone 27 there is provided a third zone 35 which acts to admix the two phases and to disperse gas throughout the mass of the flowing liquid. Mixing zone 35 utilizes a screen pack or other gas-liquid contacting device 36 to obtain an intimate dispersion of one phase in the other. The mixed fluids are then passed through port 14 into the flammable liquid contained in tank 12.

First zone 21 may be close coupled to second zone 27 by way of connector means 28 as is shown in the drawing or it may be separated therefrom by an extended length of hose or piping so long as the serial relationship of the first to the second zone is maintained. Mixing zone 35, however, is preferably adjacent to and just downstream of second zone 27 so as to minimize the segregation of gas and liquid into slugs. Coupling means 38 may be utilized to join zones 27 and 35 or those zones may be constructed as a unitary mechanism.

FIG. 2 illustrates injection means 10 as it would be used in the fighting of a fire in a diked tank 12 which is depicted in partial cross-section. Injection means 10 is placed in fluid communication with flammable liquid 41 contained in tank 12 by way of port 14 and valve 15 located near the tank floor. A dike 42 surrounds tank 12 to form a catchment basin 43 between the exterior of the tank and the dike. Although injection means 10 may be directly coupled to port 14 it is preferred to stand off some distance, at least to the outside of the dike 42, in order to reduce hazard to personnel and equipment. In that instance, injection means 10 are coupled to port 14 by means of a length of hose 45. It is also necessary to prevent flow of the liquid contained in the tank back from the tank interior through injection means 10. That may be accomplished using one or more check valves 46 which may be placed either upstream or downstream of injection means 10. As shown in the drawing, tank 12 is equipped with a roof 47 which floats atop the flammable liquid 41. Liquid 41 may be, for example, crude oil or a refined product such as gasoline or jet fuel.

A fire in tank 12, if allowed to progress for any extended period of time, will ordinarily cause tank roof 47 to fail or to tilt thus involving essentially the whole top surface of the tank in the fire. Fighting such a tank fire in accordance with the teachings of this invention is carried out in the following manner. A flow of water from supply 24 is established through injection means 10 and port 14 into the interior of tank 12. The water supply must be at sufficient pressure to overcome the pressure head of liquid contained in tank 12 as well as to ensure flow at the required rate. Typical storage tanks may be 15 to 25 m in height so expected pressure heads are in the range of 1 to 2 bars. Because the specific gravity of water flowing into tank 12 is greater than that of the hydrocarbon stored therein, water entering the tank through port 14 will merely settle to the bottom. After water flow is established, introduction of foam concentrate 23 into means 10 is begun. Water and foam concentrate flow can be simultaneously started at the expense of some foam wastage. That combined water and foam concentrate stream is immiscible in the stored hydrocarbon and is of greater specific gravity so it also will settle to the bottom of the tank.

As soon as flow of the combined water-foam concentrate stream into tank 12 has been established, introduction of a gas or gas forming liquid from source 29 into injection means 10 is commenced. Gas when vigorously admixed with a water-foam concentrate mixture produces a mousse-like foam of gas filled bubbles which will float on hydrocarbons and extinguish flame. In conventional practice, foam is produced using air as the bubble forming agent by inducting ambient air through ports into a foam creating nozzle. The use of air as the bubble forming agent in the process of this invention brings with it some severe disadvantages in that it supports combustion and has only a slight solubility in water. Consequently, it is preferred to use inert gases, particularly carbon dioxide, nitrogen and mixtures of the two, as the bubble forming agents to create the fire extinguishing foams used herein. The use of carbon dioxide as the bubble forming agent offers special advantages because of the solubility of the gas in water. Other inert gases including, for example, argon, oxygen depleted flue gases and the like, may also find use but those are less preferred.

Pressure of the gas or liquid from source 29 must be sufficient to overcome the pressure within injection means 10 and to ensure flow at the required rate as well. In a practical sense, that requires source 29 to be at a pressure of at least several bars. It is particularly advantageous to supply the inert, bubble forming gas to the fire scene as a liquified gas, either refrigerated as with liquid nitrogen or contained under pressure as with liquid carbon dioxide. The liquified gases may be supplied to injection means 10 as a liquid or as a mixed phase, liquid and gas, stream and allowed to fully gasify within means 10.

As was set out before, carbon dioxide, either alone or in admixture with nitrogen or other inert gas, is particularly preferred as the foam bubble forming agent. Carbon dioxide may be liquified under pressure and in that state is stored and readily transported in steel cylinders. When a stream of liquid carbon dioxide is merged with water at a pressure much lower than that of the stored liquified gas it both vaporizes and dissolves in the water and cools the water as well. Carbon dioxide is relatively soluble in water under ordinary conditions and is markedly more soluble under pressure. For example, at 15° C. and atmospheric pressure water will dissolve almost exactly its own volume of carbon dioxide. Consequently, feeding liquid carbon dioxide to injector means 10 results in a cooling of the water-foam concentrate stream, the dissolving of a substantial volume of carbon dioxide in the water, and a marked degree of agitation caused by vaporization of the incoming carbon dioxide liquid stream. Except for the cooling effect, much the same result is obtained by metering a gaseous stream of carbon dioxide into means 10.

Figure 3:
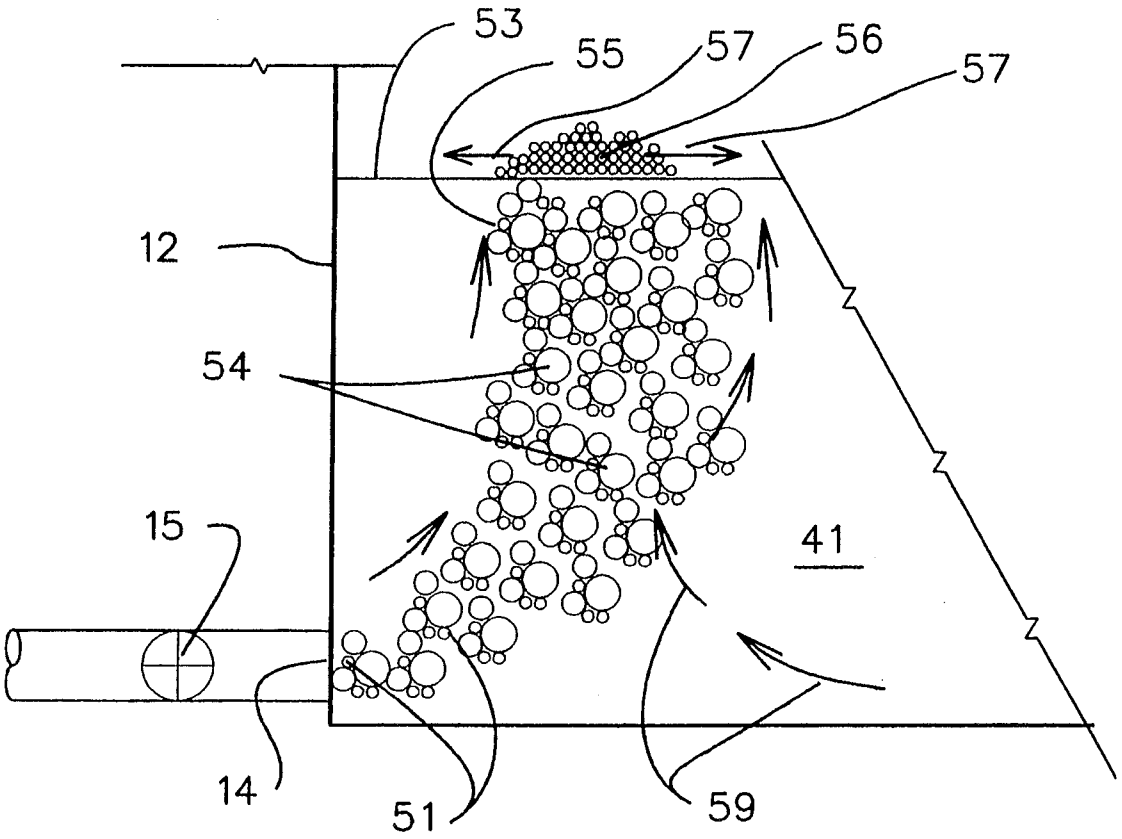
FIG. 3 illustrates the creation and placement of a fire extinguishing foam layer on the surface of a burning liquid contained in a tank.

Turning now to FIG. 3, there is depicted the effect obtained within tank 12 upon the injection of a water-foam concentrate-gas mixture through port 14 into a liquid hydrocarbon 41 contained in the tank. Gas filled foam bubbles 51, entering the tank through port 14, have a far lower specific gravity than does the liquid hydrocarbon and so rise rapidly through the hydrocarbon column toward the surface 53 of the liquid. As the gas bubbles rise toward the surface the hydrostatic pressure decreases causing the bubbles to grow in size. Those enlarging bubbles 54 have increases buoyancy and their velocity toward the surface accelerates. Further, the decrease in pressure as the liquid head decreases causes additional gas to come out of solution forming a host of tiny new bubbles 55. The upwelling foam column explodes to form a cap 56 upon the liquid surface 53. That foam cap 56 immediately forms a cover, or bridge head, extinguishing the flames over that limited area. As the stream of upwelling foam continues, foam cap 56 rapidly spreads in all directions across the surface 53 as is depicted by arrows 57 extinguishing the fire as it progresses across the surface. FIG. 3 shows the injection of the water-foam concentrate-gas mixture into the tank at but one point. While a single point injection is adequate for the extinguishment of most fires, injection of the foam forming mixture at multiple points around the periphery of the tank may also be practiced with advantage.

Yet another effect contributes to the fire extinguishing capabilities of this process. The fire itself feeds upon gases vaporized from the liquid. The rate of vaporization, in turn, depends upon the temperature of the surface liquid and upon the thermal radiation striking that surface. As the column of foam bubbles 51 rises within liquid 41 there is created a circulating flow of liquid from the lower portions of tank 12 toward the surface thereof in the manner shown by arrows 59. The liquid contained in the lower portion of the tank is, at least in the early stages of a fire, considerably cooler than is the surface liquid. Circulation of the cooler bottom liquid thus decreases the vaporization rate and effectively decreases the amount of fuel fed to the fire.

The process of this invention can successfully be practiced using commercially available foam concentrates which may be either the synthetic or protein-based type. Synthetic foams useful in the process include the aqueous film forming foams commonly referred to as AFFF and particularly alcohol-resistant AFFF foam concentrates. It is particularly preferred, however, to employ applicant's own synthetic poly viscous foams which are described and claimed in his U.S. Pat. No. 5,053,147 and in his pending U.S. patent application Ser. 07/871,070.

As may now be more fully appreciated, the methods and apparatus of this invention allow a far more effective use of fire extinguishing foams than do the techniques of the prior art. None of the apparatus employed is directly exposed to the fire as is the case with most fixed or semi-fixed extinguishing systems. The foam itself is totally protected from flame and thermal radiation until it erupts upon the burning surface. In contrast, ordinary techniques of foam application to tank fires subject the foam jet to intense thermal radiation as it passes through the flames and escapes upon the surface of the burning liquid. The use of an inert gas, particularly carbon dioxide, to fill the foam bubbles also enhances the foam survival as the atmosphere within and about the foam layer forming atop the liquid surface does not support combustion. A foam bridge head is quickly formed on the surface of the burning liquid and that bridge head is continually re-supplied with foam allowing it to rapidly spread across the entire surface of the liquid to totally extinguish the flame and to prevent its reignition and burn-back.

I claim:

1. A method for extinguishing a fire burning in a tank containing a flammable liquid comprising adding a metered foam concentrate stream to a flowing stream of water in a first zone to obtain a mixture of water and foam concentrate, adding a metered stream of a liquified inert gas selected from the group consisting of liquid carbon dioxide, liquid nitrogen, and mixtures thereof into said water and foam concentrate mixture in a second zone downstream of said first zone and allowing the liquified gas to vaporize, dispersing the vaporized inert gas throughout said water and foam concentrate mixture in a third zone, and passing the resulting mixed fluids from said third zone into the tank at a location below the surface of the flammable liquid contained therein to create a multitude of gas filled foam bubbles which rise through the liquid and spread across the liquid surface to form a fire extinguishing foam layer atop the flammable liquid.

2. The method of claim 1 wherein said liquified inert gas is liquid carbon dioxide.

3. The method of claim 1 wherein said liquified inert gas is liquid nitrogen.

4. The method of claim 1 wherein said tank is an above-ground storage tank, wherein the flammable liquid is a hydrocarbon, and wherein said injection location is adjacent the bottom of the tank.

5. The method of claim 1 wherein said tank is a compartment on a ship carrying liquid cargo and wherein said mixture of water, foam concentrate and gas is injected into said tank through existing cargo transfer lines.

6. A method for the creation and placement of a fire extinguishing foam on the surface of a burning liquid comprising:

establishing a flow of water into said liquid at a location beneath the surface thereof;

mixing a foam concentrate with said flow of water;

adding to the mixture of said water and foam concentrate a sufficient amount of bubble forming gas to cause the resulting foam to rise through said burning liquid and to escape on the surface thereof; and continuing the flow of said water, foam concentrate and gas for a sufficient period of time for a layer of foam to form and to spread across the entire surface of said burning liquid thereby extinguishing the fire.

7. The method of claim 6 wherein said bubble forming gas is an inert gas and is selected from the group consisting of carbon dioxide, nitrogen, argon, oxygen depleted flue gases and mixtures thereof.

8. The method of claim 7 wherein said inert gas comprises carbon dioxide and wherein the volume of said carbon dioxide, measured at ambient temperature and pressure, which is mixed with said water and foam concentrate liquid is at least equal to the volume of said liquid.

9. The method of claim 6 wherein said foam concentrate is present in said mixture in an amount ranging from about 0.5% to 10%.

10. The method of claim 6 wherein said tank is an above-ground storage tank, wherein the flammable liquid is a hydrocarbon, and wherein said injection location is adjacent the bottom of the tank.

11. The method of claim 6 wherein said tank is a compartment on a ship carrying liquid cargo and wherein said mixture of water, foam concentrate and gas is injected into said tank through existing cargo transfer lines.

* * * * *